United States Patent [19]

Kitahara et al.

[11] Patent Number: 4,924,200

[45] Date of Patent: May 8, 1990

[54] SPLIT BOBBIN AND COIL DEVICE

[75] Inventors: Satoru Kitahara; Koichi Yasuda; Toshio Izu, all of Tokyo, Japan

[73] Assignee: TDK Corporation, Tokyo, Japan

[21] Appl. No.: 326,812

[22] Filed: Mar. 21, 1989

[30] Foreign Application Priority Data

Mar. 23, 1988 [JP] Japan ..... 63-38946

[51] Int. Cl.[5] ..... H01F 15/02; H01F 15/10; H01F 27/30

[52] U.S. Cl. ..... 336/65; 336/192; 336/198

[58] Field of Search ..... 336/198, 208, 65, 192, 336/213, 196; 310/194, 71

[56] References Cited

U.S. PATENT DOCUMENTS

| | | | |
|---|---|---|---|
| 3,544,940 | 12/1970 | Davis | 336/192 |
| 4,602,122 | 7/1986 | Lint | 336/65 XR |
| 4,638,554 | 1/1987 | Beisser | 336/213 XR |

FOREIGN PATENT DOCUMENTS

| | | |
|---|---|---|
| 58-16257 | 4/1983 | Japan . |
| 60-143612 | 7/1985 | Japan . |
| 62-230015 | 10/1987 | Japan . |
| 62-291108 | 12/1987 | Japan . |

*Primary Examiner*—Thomas J. Kozma
*Attorney, Agent, or Firm*—Armstrong, Nikaido, Marmelstein, Kubovcik & Murray

[57] ABSTRACT

In a split bobbin designed to be rotatably mountable on a core and attached to a bobbin holding base after specific winding of coils, the split bobbin has collars at least at its both ends and cutout sections at least at two places in the outer periphery of these collars. In these cutout sections are provided lead terminal holding holes of specific depth in which rod-like lead terminals can be inserted.

Furthermore, the present invention provides a coil device which includes a split bobbin having coil winding areas, winding end fastening members provided on an outer periphery, and collars provided with through holes connected to the winding end fastening members; a core produced of a magnetic material with the bobbin mounted in a split state; a winding wound on the bobbin in the winding areas, with its end wound on the winding end fastening members; and a bobbin holding base which supports the bobbin and the coil in a fitted state, and has lead terminals routed in the through holes of the collars to the winding end fastening members. In this winding end fastening members, the end of the coil is connected with the lead terminals.

3 Claims, 7 Drawing Sheets

SPLIT BOBBIN AND COIL DEVICE

BACKGROUND OF THE INVENTION

The present invention relates to improvements in or relating to a coil device used as a line filter for controlling an electromagnetic noise occurring in, for example, an electronic equipment and passing into a transmission line, or an electromagnetic noise entering the electronic equipment through the transmission line.

A conventional coil device 100 is of such a constitution as shown in FIGS. 1 and 2 for example. Winding a coil 130 is performed with the starting end S of the wiring first wound several turns in first to third reserve wire grooves formed in both collars 121 and a center collar 122 of a two-split bobbin 120. After winding, the last end E of the winding on each coil 130 is fastened in second and fourth reserve wire grooves **123*b* and 123*d* or tacked with an adhesive on the outer periphery of each coil 130. Then, after the coiled bobbin 120 is mounted on a bobbin holding base 140, the starting end S and the last end E of the winding are loosened off from the reserve wire grooves 123*a* and 123*c* and from the tacked points on the outer periphery of the coil, then connected to corresponding lead terminals 141**, and finally soldered thereto. The conventional coil device, therefore, has the following problems.

(A) The conventional coil device requires such complicated operations as winding and unwinding the starting end of the coil winding in the reserve wire grooves **123*a* and 123*c* of each coil 130, and tacking the last end E of the coil winding to, and detaching it from, the outer periphery of the coil 130 and 130**. This coil device, therefore, is not suitable for coil winding operation by the use of automated machinery.

(B) When the starting end S of each coil winding is released from each of the reserve wire groove **123*a* and 123*c* and also when the last end E of the winding is detached from the outer peripheral section of the coil 130, each winding end is not necessarily extended straight. In addition, because the mounting of a combination of a core 110 and a bobbin 12 is accompanied with vibration at each wiring end, holding by fingers to fasten the starting end S and the last end E to the lead terminals 141 of the base 140** is also not suitable for automatic processing.

SUMMARY OF THE INVENTION

The present invention has as its object the provision of a split bobbin of the constitution that facilitates the automatic fastening of the starting and last ends of coil windings and the electrical connection of the ends of these coil windings with lead terminals, and a coil device using this split bobbin.

According to the present invention, the split bobbin is so designed and made as to be rotatably inserted over a core and mounted to a holding base after the winding of specific coils on the bobbin. In this split bobbin, collars are provided at least at both ends of the split bobbin, and cutouts are formed at least in two places of the outer periphery of both the collars. These cutouts are provided with lead terminal retaining holes of specific depth in which rod-shaped lead terminals can be inserted.

In this split bobbin of the aforesaid constitution, the opening section of the lead terminal retaining hole is provided, in its vicinity, with coil winding end fastening sections each having a vacancy at least in a part of its side and projecting long enough to wind the end of the coil winding several turns.

In the split bobbin of claim 1 or 2, the constitution stated in claim 3 includes a driven gear which is disposed in a midway point between the collars at both ends and can be engaged with an external drive gear when the coil is wound.

The coil device is of the constitution as defined in claim 4, in which a pipe member is inserted in the lead terminal retaining hole of the split bobbin defined in claim 1. One end of the pipe member is exposed out of the surface of the cutout section of the collar, long enough to wind the end of the coil winding several turn around it. After the insertion of the pipe member, one end of the rod-shaped member, one end of the rod-shaped lead terminal is inserted inside of the pipe member, while the other end of the lead terminal is projected out from the bottom surface of the coil holding base.

The constitution of claim 5, in the coil device stated in claim 4, includes the pipe member used as a flanged pipe member.

In the constitution stated in claim 6, one end of the rod-shaped lead terminal is inserted directly into the lead terminal holding hole of the split bobbin described in claim 2, and the other end of the lead terminal projects out of the bottom surface of the aforementioned holding base.

In the constitution of claim 7, the pipe member is inserted in the lead terminal holding hole of the split bobbin stated in claim 2 with its one end exposed out of the surface of the cutout section of the collar, long enough to wind the end of the coil winding several turns around the one end of the pipe member. Furthermore, one end of the rod-shaped lead terminal is inserted into the pipe member thus inserted, and the other end of the lead terminal is projected out from the bottom surface of the aforesaid holding base.

In the constitution of claim 8, the coil device comprises a split bobbin including coil winding areas, winding end fastening sections on the outer periphery, and collars having a through hole formed through in the winding end fastening section; a core produced of a magnetic material on which the bobbin is attached in a split state; a coil wound in the coil winding area of the bobbin with its end also wound around the winding end fastening section; a coil holding base supporting the bobbin and the coil in a joined state and having a lead terminal in the winding end fastening section through the through hole in the collar described above. In this winding end fastening section, the coil end and the lead terminal are connected.

The split bobbin and the coil device of the constitution as stated in claims 1 to 8 can facilitate the fastening of the starting and last ends of the coil windings and the automatic electrical connection of the ends of coil windings and lead terminals.

The present invention and its features and advantages will be set forth and become more apparent in the detailed description of the preferred embodiments presented below with reference to the accompanying drawings.

DESCRIPTION OF THE PREFERRED EMBODIMENTS

Figure 1:
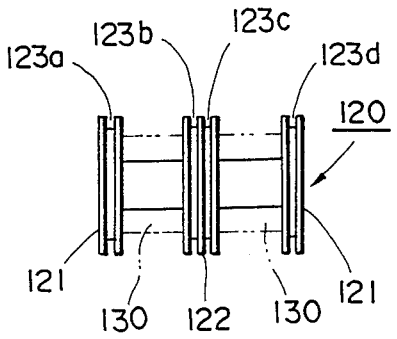
FIG. 1 (PRIOR ART)
FIGS. 1 and 2 are explanatory drawings of a conventional device.
Figure 2:
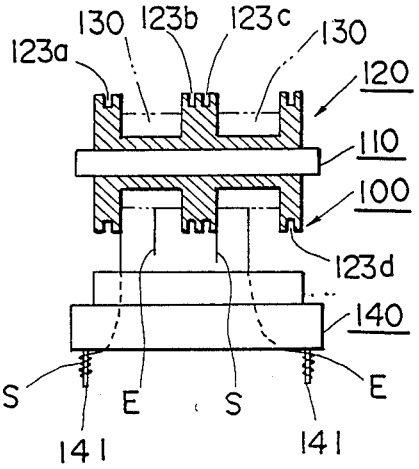
FIG. 2 (PRIOR ART)

Referring now to the drawings, there are disclosed split bobbins and coil devices incorporating preferred embodiments of the present invention.

Figure 3:
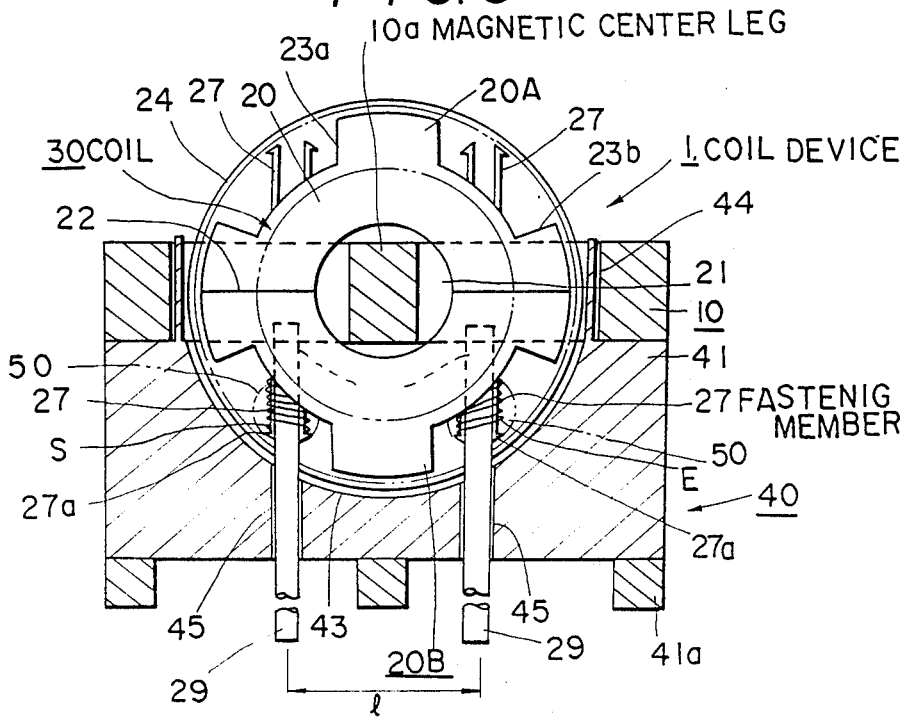
FIG. 3 is a sectional constitution drawing showing a first embodiment of a coil device according to the present invention.
Figure 4:
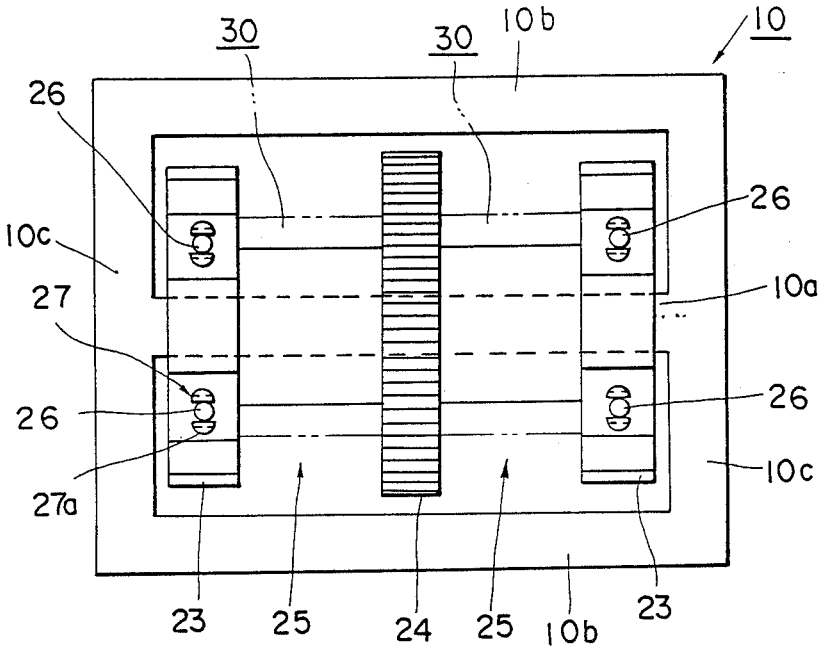
FIG. 4 is a top view of a core and bobbin assembly of the coil device shown in FIG. 1.
Figure 5:
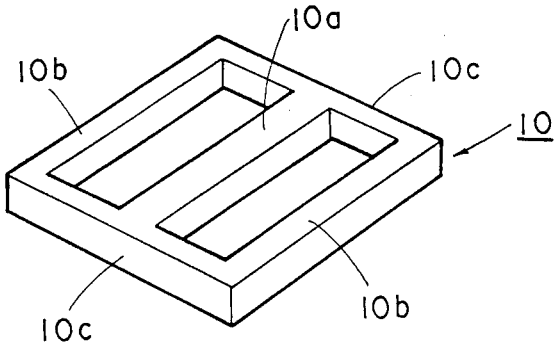
FIG. 5 is a perspective view showing one example of a core used in the present embodiment.
Figure 6:
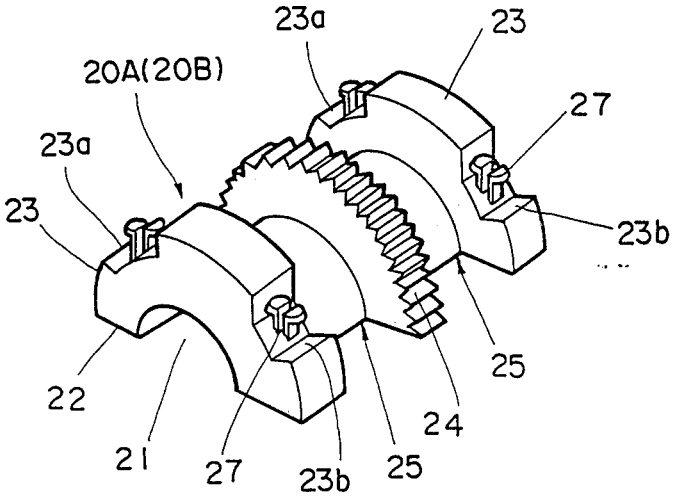
FIG. 6 is a perspective constitution drawing showing one of split bobbin halves.
Figure 7:
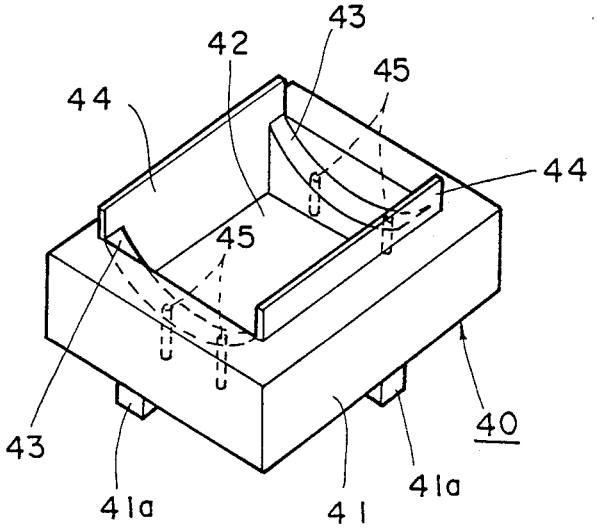
FIG. 7 is a perspective constitution drawing showing one example of a bobbin holding base.

FIG. 3 is a sectional constitution drawing showing a first embodiment of a coil device according to the present invention. FIG. 4 is a top view of a core and bobbin assembly in the coil device shown in FIG. 3. FIG. 5 is a perspective view showing one example of the core used in this embodiment. FIG. 6 is a perspective constitution drawing showing one of two split bobbin halves. And FIG. 7 is a perspective constitution drawing showing one example of a bobbin holding base.

In these drawings, the coil device 1 of the present invention comprises a ⊟-shaped closed magnetic circuit core 10 produced of, for example, a magnetic material as ferrite shown in FIG. 4, an insulated split bobbin 20 consisting of nearly half-cylindrical upper and lower bobbin halves 20A and 20B split in symmetry (identical shape), and an insulated bobbin holding base 40 for holding the combination of the core 10 to the bobbin 20 (a cored bobbin after winding the coil).

The split bobbin 20, as shown in FIG. 6 in which its one half (upper half) is illustrated, has a core mounting bore 21 at the center of bobbin halves 20A and 20B, and is so constituted as to hold a magnetic center leg 10*a* of the core 10 in the core mounting bore 21 from above and from under. Both the bobbin halves, when joined at a joint surface 22, will form a nearly cylindrical bobbin 20.

Each of the bobbin halves 20A and 20B has semi-circular collars 23 of the same shape formed on its both ends, and the area between these collars 23 and a driven split gear 24 formed at the center is set as two coil winding areas 25. In this case, each of the collars 23 has a couple of cutouts 23*a* and 23*b* in symmetrical places on the right and left. In addition, each of the cutouts 23*a* and 23*b* is provided with a lead terminal holding hole 26 of proper depth, at an appropriate spacing l, from its surface toward the joint surface 22 of the upper and lower bobbin halves 20A and 20B. The opening of this lead terminal holding hole 26 and the section of the lead terminal 29 described below and the pipe member 28 may be round or polygonal.

Furthermore, around the opening of each of these lead terminal holding holes 26, a coil winding end fastening member 27 is formed integral with a bobbin lug 20A (20B) for temporarily fastening the starting end S and the last end E of the coil 30 along both edges of the holes. This fastening member 27 consists of two separately disposed projections, each having a hook 27*a* formed at the top end. The amount of projection thereof shall be preset to the length that the projections will be at least within the outside circle of the driven split gear 24 and that the coil winding ends S and E can be wound several turns around them for fastening. Numeral 29 indicates four electrically-conductive lead terminals to be inserted in the lead terminal holding holes 26. The coil winding fastening member 27 may be constituted as a projection having, at least at a part of its side, a vacancy so formed as to allow the exposure of an electrically-conductive surface of the lead terminal 29 described above or the pipe member 28 described later.

The bobbin holding base 40 comprises a box-like (or base-like) body 41 having legs 41*a* of suitable construction at the bottom as illustrated in FIG. 7, a bobbin mounting space 42 formed at the center of the base body 41 such that the assembly of the core 10 and the bobbin 20 can be supported therein, two curved sections 43 formed beside walls at both ends of the space 42, and insulated spacers 44 provided along both the sides of the space 42. In this case, each of the two curved sections 43 has a couple of mounting holes 45 large enough to relatively loosely insert each of the four lead terminals 29, at the aforesaid spacing l, such that when the aforementioned assembly of the core 20 and the bobbin 20 is mounted in the space 42, the four lead terminals 29 are inserted into these mounting holes 45, projecting by a specific length out from the bottom surface of the base body 41. The length of the lead terminal 29 is also predetermined to conform to this requirement.

Next, a process for manufacturing the coil device of the first embodiment of the aforesaid constitution will be explained.

Assembly of Two Bobbin Halves and Core

First, after the two bobbin halves 20A and 20B are set on the center magnetic leg 10*a* of the core 10 from above and from under, both the bobbin halves 20A and 20B are jointed into a split bobbin 20 by some suitable means of bonding.

In this state, the center magnetic leg 10*a* of the core 10 is positioned through the core mounting hole 21 of the bobbin 20, while side magnetic legs 20*b* and connecting magnetic legs 10*c* are formed to enclose the outer periphery of the bobbin 20. Also, the split bobbin 20 is rotatable on the center of the center magnetic leg 10*a*; the projecting ends of the coil winding end fastening members 27 are positioned within a range in which the rotation of the split bobbin 20 will not be interfered; and the driven split gear 24 is joined into a circular form, thus providing a complete form of gear.

Coil Forming

The coil winding procedures will now be explained by referring to one of two coils 30.

(1) In one cutout section (23*a* for example), wind the starting end S of the coil 30 several turns around the coil winding end fastening member 27.

(2) To form a coil 30, a drive gear, which is not illustrated, with the driven split gear 24 on the bobbin side, and operate a suitable drive motor to rotate the bobbin 20 around the center magnetic leg 10*a* of the core 10, while winding a winding wire by a specific number of turns in the coil winding area 25.

(3) After the winding of the coil 30 is finished, wind the last end E of the coil 30 several turns on the coil winding end fastening member 27 provided in another cutout section 23*b*.

(4) Do the same procedure for another coil 30 at the same time or in sequence, thus completing two coils.

(5) After the completion of the two coils, insert the four lead terminals 29 into the lead terminal holding holes 26.

(6) In the aforementioned coil winding end fastening members 27, attach the coil winding ends S and E to the lead terminals 29 for electrical connection by soldering 50.

Connection of Core and Bobbin Assembly with Bobbin Holding Base

The assembly of the core 10 and the bobbin 20 with the two coils 30 wound thereon is set in the space 42 of the bobbin holding base 40. In this case, the four lead terminals 29 led out of the bobbin 20 side are first inserted into the mounting holes 45 formed in the curved sections 43 of the base 40. Thereafter, the assembly of the core 10 and the bobbin 20 is lowered until the lower surface of the side magnetic leg 10*b* and the connecting magnetic leg 10*c* of the core 10 come in contact with the upper edge of the base 40, thus assembling the assembly of the core 10 and the bobbin 10 to the bobbin holding base 40. In this state, the spacer 44 goes in between the outer peripheral surface of the coil 30 thus wound and the side magnetic leg 10*b* of the core 10, thereby providing perfect insulation therebetween.

In the coil device 1 of the first embodiment constituted as described above, since the four lead terminals 29 protrude by a specific amount out of the bottom surface of the base 40 as shown in FIG. 3, the coil device 1 in this state can be electrically connected reliably to a circuit board by mounting the coil device 1 to the circuit board and soldering the end of the lead terminal 29 to the circuit board.

Figure 8:
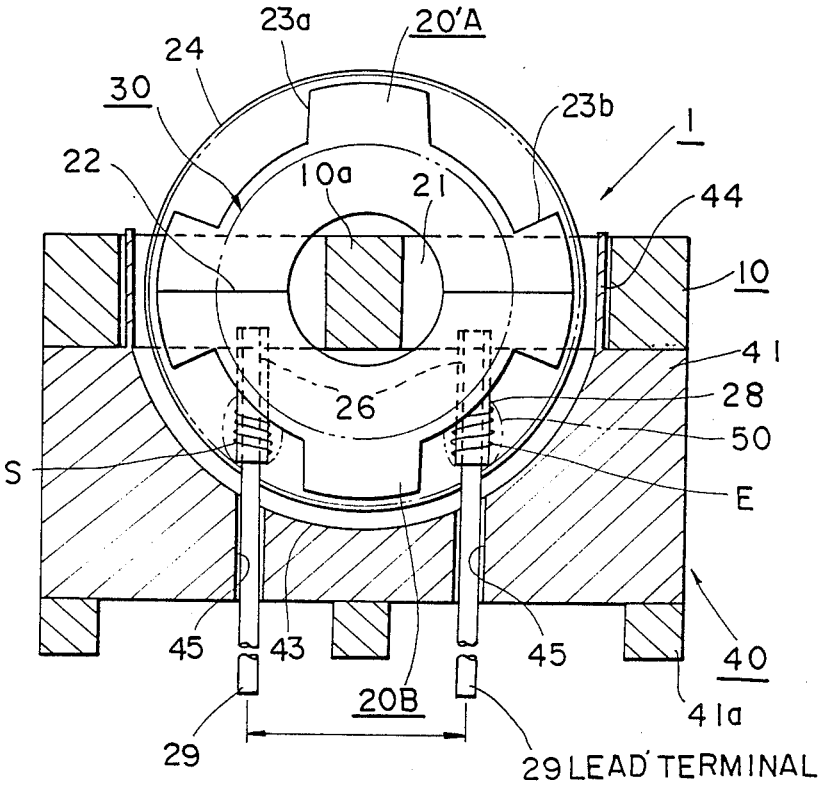
FIG. 8 is a sectional constitution drawing showing a second embodiment of the present invention.
Figure 9A:
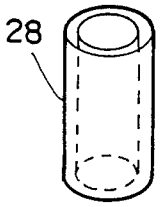
FIGS. 9A and 9B are perspective schematic drawings of a pipe member using the embodiment shown in FIG. 8.

FIG. 8 shows a second embodiment of the present invention, in which each of the bobbin halves 20'A and 20'B is not provided with the coil winding end fastening members 27. That is, in this example, a pipe member 28 produced of an electrically-conductive material as shown in FIG. 9A is inserted into the lead terminal holding holes 26 formed in the cutout sections 23*a* and 23*b* of each bobbin half 20'A, 20'B, and the starting end S and the last end E of the coil 30 are fastened on the pipe members 28. In this case, the manufacturing process is as shown below. The aforesaid processes Connection of Two Bobbin Halves and Core and Connection of Core and Bobbin Assembly with Bobbin Holding Base are identical to those in the first embodiment and therefore are not described herein.

Mounting of Pipe Members

Prior to starting the winding of the coil 30, four pipe members 28 are inserted into the lead terminal holding holes 26 made in one bobbin half (20B for example) of the bobbin 20 that has been jointed, such that the starting end S and the last end E of winding of the coil 30 will be fastened.

Coil Formation (1) In one cutout section (23*a* for example), wind the starting end S of the coil 30 several turns around the pipe member 28 that has been inserted in the lead terminal holding hole 26 of one cutout section 23*a*.

(2) Winding the coil 30 while rotating the bobbin 20 can be performed by the similar procedure as the first embodiment.

(3) When the winding of the coil 30 has been finished, wind the last end E of the coil 30 several turns around the pipe member 28 inserted in the lead terminal holding hole 26 of another cutout section 23*b*.

(4) Perform the same procedure for another coil 30 at the same time or in sequence, thus completing two coils.

(5) After the completion of the two coils 30, insert the four lead terminals 29 into the holes of the pipe members 28, and then attach the coil winding ends S and E to the pipe member 28 and the lead terminal 29 for electrical connection by soldering 50.

Figure 9B:
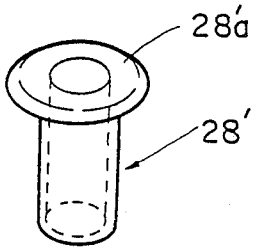

In this second embodiment also, the four lead terminals 29 project by a specific amount out of the bottom surface of the base 40. A pipe member 28' having an annular collar 28'*a* at the top end as shown in FIG. 9B may be inserted, in place of the pipe member 28 shown in FIG. 9A, in the lead terminal holding hole 26. The use of this pipe member 28' facilitates the winding of the coil winding ends S and E.

Figure 10:
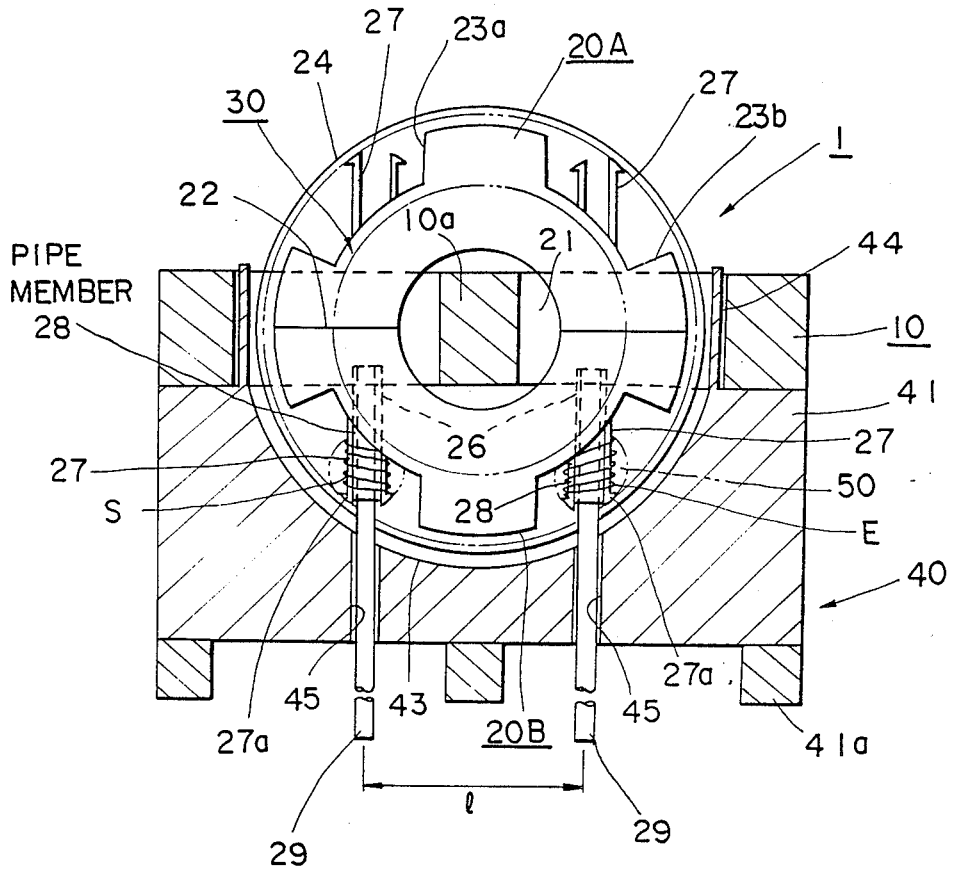
FIG. 10 is a sectional constitution drawing showing a third embodiment of the present invention.

FIG. 10 shows a third embodiment of the present invention, in which each of the bobbin halves 20A and 20B is provided with the coil winding end fastening members 27 and further with the pipe members 28 inserted in the lead terminal holding holes 26. The coil device of this embodiment is manufactured by a combination of the manufacturing processes previously stated in the first and second embodiments, which, however, will not be described herein for the purpose of avoiding complexity.

In the split bobbin for the coil device, and the coil device, of the present invention, as described above as to several embodiments, the split bobbin 20 is provided with collars 23 at least at its both ends, wherein the winding ends S and E of the coil 30 are directly fixedly attached and electrically connected. Therefore each end of the coil 30 can readily be fixed as compared with conventional like devices, thus facilitating automated coil winding operation. In addition, in fastening the coil winding ends to the collar 23, the lead terminal is not inserted through the two bobbin halves 20A and 20B; accordingly, there is no necessity to move the lead terminals before and after coil winding operation, thereby improving operation efficiency.

Figure 11:
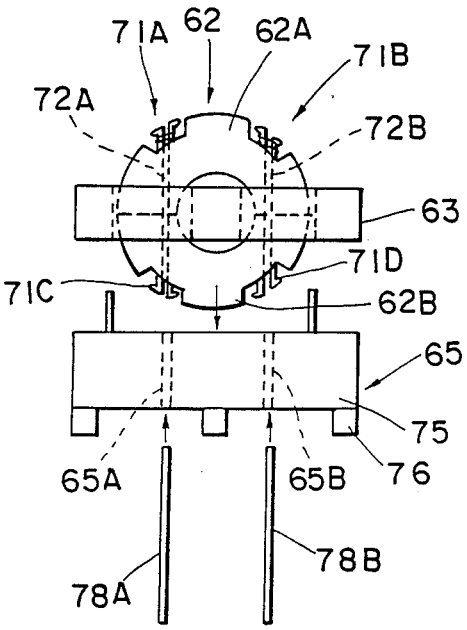
FIGS. 11 and 12 are an exploded front view and an assembly front view respectively showing a fourth embodiment of the present invention.
Figure 12:
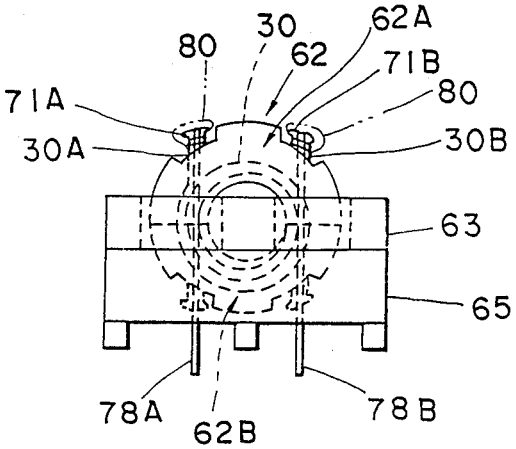

FIGS. 11 and 12 show a fourth embodiment of the present invention. In these drawings, split bobbin halves 62A and 62B, a ⊟-shaped core 63, a bobbin holding base 65, winding end fastening member 71A, 71B, 71C and 71D provided at each bobbin collar section have the similar constitution as those corresponding members shown in FIG. 3. This embodiment features through holes 72A and 72B provided through the winding end fastening members 71A and 71C, and 71B and 71D, at the collar sections of the upper and lower bobbin halves 62A and 62B, and also through holes 65A and 65B, in the bobbin holding base 65, connected to the through holes 72A and 72B made in the bobbin. Furthermore, with the bobbin (with coils wound) assembled on the core 63 mounted on the bobbin holding base 65, two lead terminals 78A and 78B are inserted from below into both the through holes 65A and 72A and the through holes 65B and 72B, such that their ends will be exposed at the winding end fastening members 71A and 71B provided at the collar sections of the upper bobbin half 62A. And finally, the lead terminals 78A and 78B are electrically connected to the wiring ends 30A and 30B by attaching with solder 80, 80. In this embodiment, the lead terminals 78A and 78B are inserted from outside; but another method may be adopted, for example, a method to preset the lead terminals separately in the bobbin holding base 65, with their top ends projecting long out, so that when the bobbin 62 is held in the base 65, the bobbin is inserted over the projecting lead terminals 78A and 78B.

Figure 13:
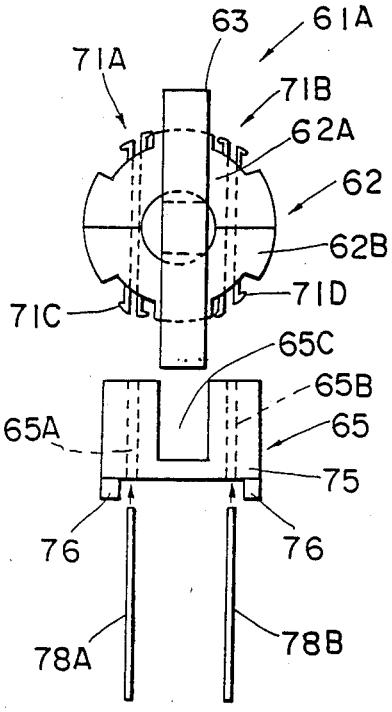
FIG. 13 is an exploded front view showing a fifth embodiment of the present invention.

FIG. 13 shows a fifth embodiment of the present invention, which is basically the same as that shown in FIG. 11, with the exception that the mounting angle of the core 63 in relation to the bobbin 62 has been changed through 90 degrees, and that a groove 65C is provided for holding the projecting end of the core 63 on the base 65 side.

Figure 14:
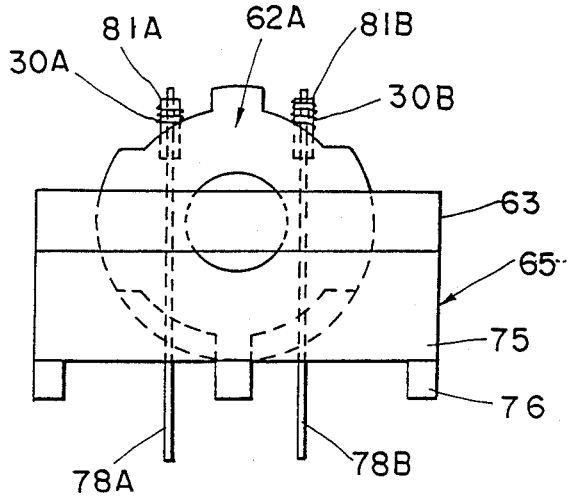
FIGS. 14 and 15 are front views showing a sixth embodiment of the present invention.
Figure 15:
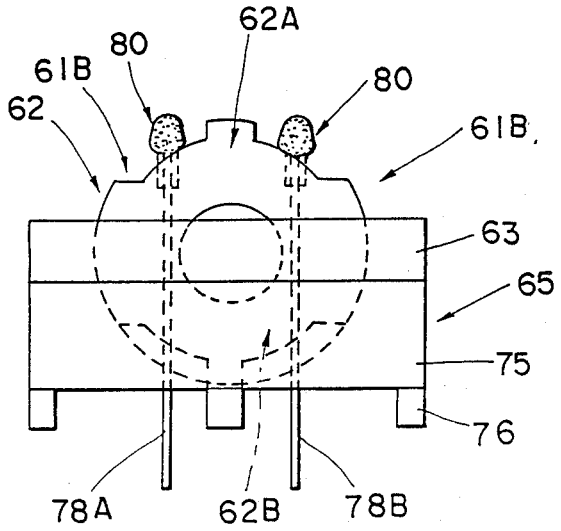

FIGS. 14 and 15 show a sixth embodiment of the present invention, which is basically the same as that shown in FIG. 11. In this case, however, metal pipes 81A and 81B are fitted in the collar section of the upper bobbin half 62A in place of the winding end fastening members 71A and 71B shown in FIG. 11, and the top ends of the lead terminals 78A and 78B routed through under the base 65 are exposed out on the pipes 81A and 81B; and the winding ends 30A and 30B each fastened to the fastening members are electrically connected with solder 80, 80. In this embodiment, the pipes 81A and 81B used as the winding end fastening members are provided only on the upper bobbin half 62A, not on the lower bobbin half 62B. The pipes, however, may be provided at both bobbin halves. Furthermore, pins may be used in place of the metal pipes.

While several embodiments of the present invention have been described, it will be apparent to those skilled in the art that various changes and modifications may be made therein without departing from the spirit and scope of the present invention as claimed. For example, in the illustrated embodiments disclosing the bobbin having two coil winding areas, the number of coil winding areas can be determined in accordance with purposes. In this case, the number of collars, lead terminals, pipe members, etc. can be increased with the increased number of the coil winding areas. Furthermore, the construction of bobbins to be applied to the present invention is not limited to the split type that can be divided into two halves, but any divisible type will suffice.

What is claimed is:

1. A coil device including a split bobbin having coil winding areas, winding end fastening members provided on an outer periphery, and collars, provided with through holes, connected to said winding end fastening members; a core produced of a magnetic material with said bobbin mounted in a split state; a coil wound on said bobbin in said winding areas, with its end wound on said winding end fastening members; and a bobbin holding base which supports said bobbin and said coil in a fitted state, and has lead terminals routed in said through holes of said collars to said winding end fastening members, the end of said coil is connected with said lead terminals at said winding end fastening members.

2. A coil device as claimed in claim 1, wherein said winding end fastening members and said through holes are provided at least at two places in said collar.

3. A coil device as claimed in claim 1, wherein said winding end fastening members are pins produced of an electrically-conductive material fitted in said through holes.

* * * * *